US005950848A

United States Patent [19]

Baudin

[11] Patent Number: 5,950,848

[45] **Date of Patent: *Sep. 14, 1999**

[54] CAP ARTICULATED TO A CONNECTING ELEMENT

[75] Inventor: Gilles Baudin, Domont, France

[73] Assignee: L'Oreal, Paris, France

[ * ] Notice: This patent is subject to a terminal disclaimer.

[21] Appl. No.: 08/904,426

[22] Filed: Jul. 31, 1997

[30] Foreign Application Priority Data

Aug. 29, 1996 [FR] France ..... 96 10575

[51] Int. Cl.[6] ..... B65D 39/00; B65D 43/16

[52] U.S. Cl. ..... 215/237; 215/352; 220/810; 220/837; 222/546; 222/556

[58] Field of Search ..... 220/335, 339, 220/341, 344, 315, 255, 256, 259, 804, 795, DIG. 19, 373, 810, 820, 823, 827, 833, 837, 836, 838; 215/235, 237, 364, 352; 222/542, 546, 556

[56] References Cited

U.S. PATENT DOCUMENTS

| | | | |
|---|---|---|---|
| 788,565 | 5/1905 | Van Eyck | 215/352 X |
| 806,602 | 12/1905 | Uhl | 215/352 X |
| 4,569,457 | 2/1986 | Hatakeyama et al. | 215/364 X |
| 4,711,360 | 12/1987 | Ullman | 220/335 X |
| 5,221,017 | 6/1993 | Cistone et al. | 220/335 X |
| 5,437,383 | 8/1995 | Stull | 215/235 X |
| 5,501,348 | 3/1996 | Takeuchi | 215/235 X |
| 5,769,253 | 4/1996 | Gross | 220/339 X |

FOREIGN PATENT DOCUMENTS

| | | |
|---|---|---|
| 0 208 413 | 1/1987 | European Pat. Off. . |
| 0 494 306 | 7/1992 | European Pat. Off. . |
| 0 629 560 | 12/1994 | European Pat. Off. . |
| 2 662 144 | 11/1991 | France . |

*Primary Examiner*—Allan N. Shoap
*Assistant Examiner*—Joe Merek
*Attorney, Agent, or Firm*—Oblon, Spivak, McClelland, Maier & Neustadt, P.C.

[57] ABSTRACT

A dispensing cap (3) having a body (32) made of a rigid or semirigid material, intended to be mounted on a reservoir (21) containing a product of a fluid-to-viscous consistency, is provided with an opening (4) permitting the dispensing of the product and a lid (5) of a rigid or semirigid material capable of obturating the opening (4). The lid (5) is articulated on the body (32) in the vicinity of an articulation axis (A) so as to be capable of selectively passing from an open position to a closed position, and is connected to the body (32) by a connecting element (10) having one of its ends joined to the lid (5) and its other end joined to the body (32). The connecting element (10) is disposed so as to be situated on one side of the articulation axis (A) in the open position and on the other side of the axis (A) in the closed position. The connecting element (10) is subjected to an elongation when the lid (5) passes from one to the other of its open and closed positions. The connecting element (10) is made of an elastomeric material.

16 Claims, 1 Drawing Sheet

CAP ARTICULATED TO A CONNECTING ELEMENT

BACKGROUND OF THE INVENTION

1. Field of the Invention

The present invention relates to a dispensing cap intended for a reservoir containing a fluid or viscous fluid product (hereinafter sometimes referred to as a product of a fluid to viscous consistency) to be dispensed, as well as to a dispensing unit provided with such a cap. The cap is provided with a closing system capable of being opened for the dispensing of the product and of being closed for its preservation.

DESCRIPTION OF THE RELATED ART

Reservoirs fitted with a cap of this kind are commonly used in different fields for the storage and dispensing of liquid or viscous products, for example, in the cosmetic, food, household, pharmaceutical or parapharmaceutical fields. These products may be, in particular, shampoos, antiseptics, household cleaning materials or dishwashing products. By using a dispensing cap, it is possible to avoid the leakage of the product during its transport and storage and the product is protected from external contamination. Moreover, such a cap allows the user to dispense the product contained in the reservoir easily and to meter it accurately.

To date there are on the market a large number of dispensing caps of different designs for the above mentioned consumer products. Most of them are made of a single material and have a body connected by a hinge to an articulated lid, allowing the user to open or close the reservoir at will. Frequently, the hinge is a film hinge, so that the cap and the lid form an integral unit.

For example, WO-A-87/00512 discloses a cap molded in a single piece which comprises a body, a film hinge and a lid, the hinge being provided with a device imparting an over center or "snap action" to the operation of opening and closing the lid. This cap is capable of keeping the lid in two positions: namely (i) a completely open position and (ii) a position close to the closed position, or a partly closed position. The open position permits the dispensing of the product, while the partly closed position facilitates the complete closure of the reservoir.

In this cap, one or the other of the positions (i) and (ii) is obtained by means of one or two straps folded in an L shape and disposed in the vicinity of the hinge, the ends of the "L" being joined to the body of the cap and to the lid, respectively. When the lid passes from one of the positions (i) and (ii) to the other, the strap or straps will be subjected to a deformation of the angle of the "L".

Another cap with a "snap action," comprising a lid articulated by means of a hinge and made in a single piece is described in WO-A-84/04906. In this cap, the "snap action" is provided by two straps disposed on either side of the hinge and whose ends are attached to the body and to the lid of the cap, respectively. When the user causes the lid to pivot from the open position (i) to the partly closed position (ii), or vice versa, the straps are subjected to elongation.

Practice has shown that in the course of use, the material of which the cap is made, which is generally a rigid or semi-rigid thermoplastic material such as polyethylene or polypropylene, does not withstand many manipulations of opening and closing the cap. Indeed, frequently, the consumer will be faced with deformations or fractures of the hinge and/or of the strap or straps in particular, preventing the cap from functioning properly. This effect is all the more frequent when the container has a large volume and when the dispensing of the product contained therein is thus accompanied by a high number of manipulations of the lid.

Moreover, the choice of the material that can be used for the caps described above is relatively limited. The caps include parts which must ensure a specified rigidity (the body and lid) and parts which must be elastically deformable (the hinge and straps). The choice of an unduly rigid material will result in the fracture of the hinge and/or of the straps due to the fatigue of the material after many uses, or a hard, incorrect and uncomfortable operation. On the other hand, the choice of an unduly flexible material will result in flaccid operation and the cap lacking stability of shape.

EP-A-0 629 560 discloses a cap which is articulated to a lid by means of a film hinge. This cap has a "snap action" returning the lid into a single completely open position. This position is ensured by an attached piece of rubber interposed between the body and the lid of the cap. Due to the mounting of this piece of rubber, when it is intended to close the lid it is necessary to exert a pressure for the lid to be locked on the cap. If this pressure is insufficient, the lid will automatically return into its open position under the effect of the elastic force produced by the piece of rubber. However in conditions of use such as during a bath or shower, it is sometimes difficult to exert such a pressure with wet hands. Moreover, the need for use of a rubber part makes it impossible to use manufacturing techniques such as dual or duplicate injection molding. Similarly, the fixing of the piece of rubber to the body of the cap cannot be effected by thermofusion because of the physical/chemical incompatibility of the materials used. Furthermore, the manufacture of this cap requires complicated equipment for the mounting of the attached elastic piece, resulting in a high cost.

SUMMARY OF THE INVENTION

Thus it is an object of the present invention to provide a dispensing cap avoiding the drawbacks of the known caps but having a superior operating mode and a prolonged service life.

It is another object of the invention to provide a dispensing cap usable with large volume containers and permitting the dispensing of a high number of doses of the product.

It is another object of the invention to provide a dispensing cap which can be made at low cost using techniques such as duplicate injection molding.

According to a first aspect of the invention, the above and other objects are achieved a dispensing cap comprising a body intended to be mounted on a reservoir containing a product of a fluid-to-viscous consistency, the cap being made of a rigid or semirigid material and provided with an opening permitting the dispensing of the product. A lid made of a rigid or semirigid material is capable of fully obturating the opening, this lid being articulated on the body in the vicinity of an articulation axis so as to be capable of selectively passing from an open position to a closed position, and connected to the body by a connecting element which has one end joined to the lid and another end joined to the body. The connecting element is disposed so as to be situated on one side of the articulation axis in the open position and on the other side of the articulation axis in the closed position, and the connecting element is subjected to an elongation when the lid passes from one position to the other. The connecting element is made of an elastomeric material.

Advantageously, the liquid, viscous or powdery product to be dispensed is capable of flowing under its own weight, or by compression of the reservoir which has flexible walls. The product contained in the reservoir is, for example, a shampoo or a body lotion whose viscosity is generally in the range of 50 mPa·s to 5 Pa·s.

The elastic connecting element may be advantageously made in a single step during the manufacture of the cap, for example by duplicate injection molding comprising overmolding the rigid or semirigid body with an appropriate elastomeric material.

Generally, the elastomeric material forming the connecting element may be a thermoplastic elastomer, preferably one which is physically and/or chemically compatible with the rigid or semirigid material and capable of creating a solid bond during the manufacture of the cap by the duplicate injection molding of the two materials. Thus by first injecting the rigid or semirigid material into the mold, and by subsequently overmolding the flexible material, a bond is created between the elastomeric material and the rigid or semirigid material. This thermoplastic elastomer is chosen, for example, from the group of copolymers of propylene and/or ethylene; polyether blocamides; polyvinyls; terpolymers of ethylene, propylene and of a diene (EPDM); sequenced polymers of styrene-butadiene (SBS); sequenced polymers of styrene-ethylene-butadiene (SEBS-SIS); thermoplastic polyurethanes; and mixtures of polypropylene with one of the following elastomers: sequenced polymers of styrene-ethylene-butadiene (SEBS-SIS), terpolymers of ethylene, of propylene and of a diene (EPDM), or sequenced polymers of styrene-butadiene (SBS).

According to another aspect of the invention, a dispensing unit having a product reservoir is equipped with a dispensing cap conforming to the first aspect of the invention. In practice, the dispensing unit is comprised by a relatively rigid bottle or by a compressible tube. Preferably it has a neck on which the dispensing cap is fixed by screwing, catch engagement, welding or any other known means.

The cap and lid may be made, for example, of polypropylene or polyethylene. Preferably, the lid is articulated to the body of the cap by a film hinge. This hinge may be made discontinuously in two parts, so that the connecting element is disposed between the two parts of the hinge.

The connecting element is, for example, an elongate strip whose ends are fixed to the body and the lid respectively. Means for anchoring the ends of the strip may be provided on the body and the lid, respectively, for making their fastening more solid. These anchorage means are constituted, for example, by one or several small bars embedded in the elastomeric connecting element, these bars being made of a rigid or semirigid material obtained by molding together with the body of the cap.

The cap may instead be formed of a single part in which the body, the lid and the connecting element form an integral unit.

When the cap is manufactured of two different materials, one rigid or semirigid and the other made of an elastomer, it is possible to make provision for some of the features described below. Thus the body of the cap and/or the lid may be provided with a gripping zone overmolded with a layer of an elastomeric material intended to facilitate the opening of the lid and to make its manipulation more pleasant.

Moreover, a stopper plug may be provided on the internal side of the lid and capable of stoppering the dispensing opening, this stopper plug being provided with an external covering made of an elastomeric material. This arrangement ensures a particularly leakproof stoppering, as well as compensation for possible molding tolerances.

When the stopper is hollow, it can advantageously be filled with a flexible elastomeric material. With this arrangement, it is possible to avoid an untimely outflow of product residues during the opening of the cap, which commonly occurs with a hollow stopper.

The body may, moreover, have an annular sealing gasket made of a flexible elastomeric material in leakproof contact with a peripheral edge of the lid when the lid is in its folded down position.

It is also possible to provide one or more gripping zones made of an elastomeric material obtained by a duplicate molding operation on the lid and/or a portion of the body of the cap, facilitating the opening of the lid and creating an "antislip" effect if required.

The above mentioned features, i.e., the elastic strip, the covering of the stopper or of the opening, the duplicate molding of the gripping zones and the sealing gasket can be obtained in single manufacturing step by using a duplicate injection molding process that consists of a first stage injection molding of the cap articulated to the lid of a rigid material, and a second stage in which there are obtained the connecting element, the covering of the stopper or of the opening, the duplicate molding of the gripping zones, and the gasket of a flexible thermoplastic material.

BRIEF DESCRIPTION OF THE DRAWINGS

To render the present invention more readily understood, an embodiment of the dispensing cap in accordance with the invention will now be described, by way of purely illustrative and nonrestrictive examples, with reference to the attached drawings in which.

DETAILED DESCRIPTION OF THE PREFERRED EMBODIMENT

Figure 1:
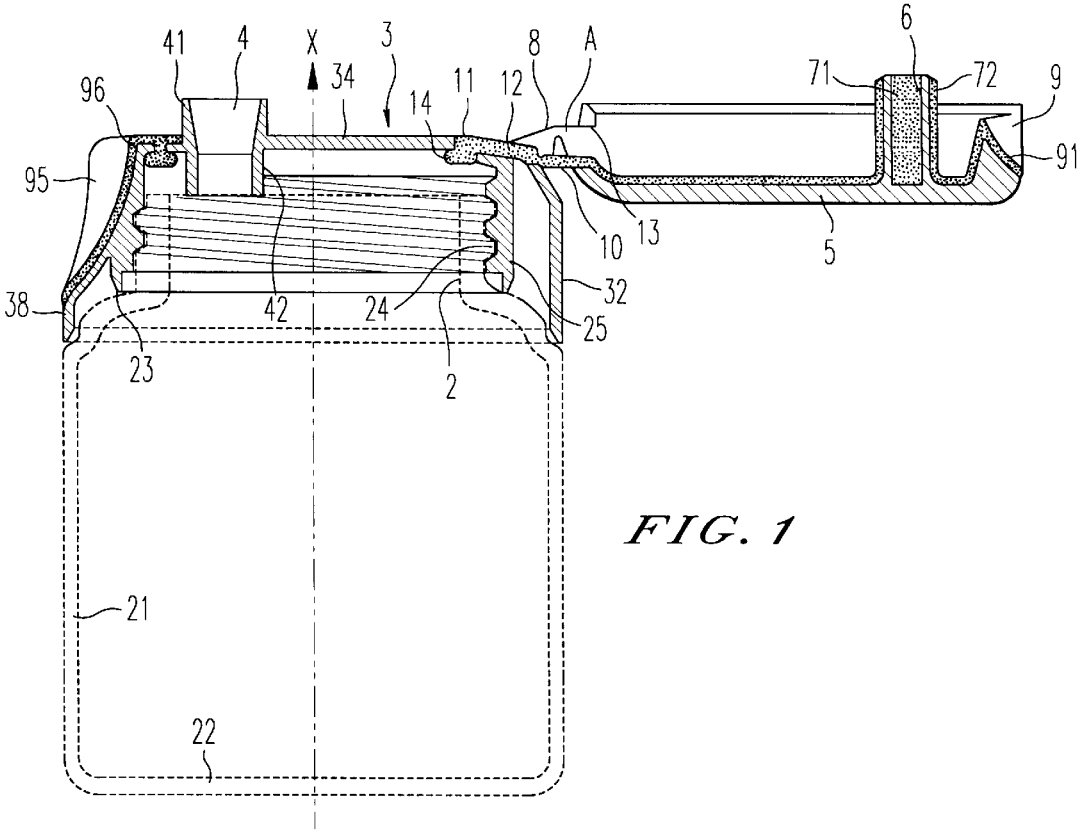
FIG. 1 shows an axial sectional view of a dispensing unit provided with a dispensing cap in accordance with the invention, in its open position.

Referring to FIG. 1, a dispensing unit comprises a reservoir 21 having a longitudinal axis X and fitted with a dispensing cap 3 having a body 32. The reservoir 21 has a closed bottom 22 and, on the opposite side to the bottom, a neck 2 provided with an external thread 24 for fixing the cap body 32 on the reservoir. For this purpose, the cap body 32 has an internal cylindrical skirt 25 provided with an internal thread complementary to the thread 24 of the neck 2 and terminating in an edge 23 which bears on the reservoir 21. The reservoir 21 has a generally circular or oval cross-section, but this may be of any shape, for example polygonal or asymmetrical. It is made, for example, of high density polyethylene. The body of the cap is made of a rigid or semi-rigid material such as polypropylene.

The body 32 of the cap 3 is formed as a plate 34 from which the internal skirt 25 extend and provided at its circumference with an integral film hinge 8, by means of which a lid 5 is articulated, allowing the lid to pivot round an axis A forming the articulation axis of the hinge. The lid 5 has a circular peripheral edge 51 and is concave towards the reservoir. A dispensing opening 4 is provided in the plate 34 on the opposite side to the hinge 8 and in a plane passing through the hinge and through the longitudinal axis X of the reservoir 21. The opening 4 is defined by a cylindrical tube 41, 42 extending on either side of the plate 34. An emergent portion 41 of the tube has a conical internal shape flaring outwardly. This tube constitutes a flow reducer and the emergent portion 4 functions as a spout.

The hinge 8 is formed of two parts 8*a*, 8*b* separated by a recess 8*c*. Two small rigid bars 12, 13 with an orientation parallel to the articulation axis A are embedded in a flat strip 10 made of an elastomeric material and form means for anchoring the strip 10 to the cap and lid. For this purpose, the bar 12 is mounted to or formed with the cap body 32 and the bar 13 is mounted to or formed with the lid 5. The ends of the strip are also joined to the body 32 of the cap and the lid 5, respectively. The attachment of this strip 10 to the body 32 and to the lid 5 is obtained by the thermofusion of the respective materials during the manufacture of the cap 3. To further reinforce the strip 10, additional anchorage points 14 may be provided on each portion adjoining the ends of the strip 10.

This strip 10 is disposed slightly beneath the articulation axis A of the hinge, that is, on the side towards the reservoir, so that in the fully open position the lid 5 is kept in this position by the elasticity of the flexible strip 10. When the lid 5 is closed, it pivots about the axis A which causes the strip 10 to extend. When the lid reaches a position of maximum extension of the strip 10, the elasticity of the strip 10 restores the lid 5 into a partly open position. From the partly open position, the lid 5 can be closed completely by causing the stopper 6 to frictionally enter to the opening 4. The flexible strip 10 is made, for example, of a mixture of polypropylene and a block polymer of styrene-ethylene-butylene-styrene.

The plate 34 is bent in the direction towards the body 3, forming a cover skirt whose lower end edge 38 forms an extension of the shape of the reservoir 21.

In the closed position of the lid, the dispensing opening 4 is closed by a stopper 6 obturating the tubular portion 41. This stopper 6 is hollow and has an external covering 72 made of a flexible material. The internal diameter of the tubular portion and the external diameter of the covering 72 are chosen in such a way that the stopper 6 can frictionally enter and close the opening 4 in a leakproof manner when the lid is closed. Advantageously, this diameter is of the order of 3 to 8 mm, depending on the viscosity of the product to be dispensed. This viscosity is typically in the range of 50 mPa·s to 5 Pa·s.

Of course, it is possible to reverse this arrangement, i.e., to dispose the covering 72 of a flexible material inside the opening 4. As may be seen in FIGS. 1 and 2, the inside of the stopper 6 is filled with a flexible material 71.

Figure 2:
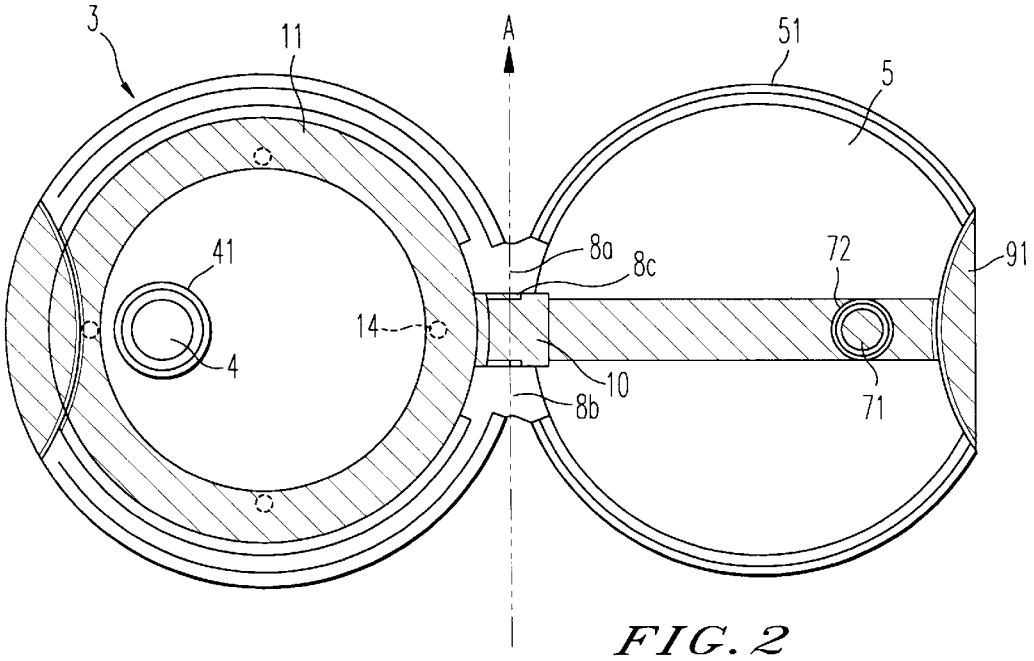
FIG. 2 shows a top view of the cap of FIG. 1.

As illustrated in particular in FIG. 2, the plate 34 has, at its circumference, an annular gasket 11 made of a flexible material. The gasket may be formed as part of the strip 10.

On the side opposite the hinge 8, the cover skirt has a recessed zone 95 in the shape of a circular arc, facilitating the gripping and opening of the lid 5. The surface 96 of this zone is formed by a layer of a flexible material. Similarly, the lid 5 has a gripping zone 91 in the shape of a concave bent portion 9 which is also formed of a flexible material. The use of a flexible material for the gripping zones, for example, SANTOPRENE® (a mixture of polypropylene with terpolymers of ethylene, propylene and a diene (EPDM)), marketed by the AES Company, provides the user with a pleasant feel and easy manipulation of the cap. By using a material of this type it is even possible to obtain an "antislip" effect, which is advantageous when the user uses a surfactant body cleansing product in a shower or in the bath.

This method of manufacturing the cap in accordance with the invention by the successive duplicate injection molding of rigid or semi-rigid and elastomeric materials is very simple, allowing it to be manufactured in a single molding cycle of short duration. This cap can then be manufactured at an advantageous cost. Its service life is practically unlimited.

What is claimed is:

1. A dispensing cap comprising:

a substantially rigid body mountable on a reservoir containing a fluid product provided with an opening for dispensing the product;

a substantially rigid lid articulated on the body in the vicinity of an articulation axis so as to be capable of selectively passing from an open position to a closed position in which the lid obturates the opening; and an elongatable elastomeric connecting element having one end joined to the lid and another end joined to the body, the one end of the connecting element being disposed on one side of the articulation axis in the open position of the lid and extending to another side of the articulation axis in the closed position of the lid such that said elastomeric connecting element stretches while said lid moves between said open and closed positions.

2. A cap according to claim 1, wherein the elastomeric connecting element is capable of creating a mechanical bond with the material of the body and the lid by thermofusion.

3. A cap according to claim 1, wherein the connecting element is overmolded onto the body and the lid by duplicate injection molding.

4. A cap according to claim 1, wherein the body, the lid and the connecting element together form an integral unit.

5. A cap according to claim 1, wherein the material of the body and the lid is one of polypropylene and polyethylene.

6. A cap according to claim 1, wherein the material of the elastomeric lid is chosen from the group consisting of copolymers of propylene and ethylene; polyether blocamides; polyvinyls; terpolymers of ethylene, propylene and of a diene (EPDM); sequenced polymers of styrene-butadiene (SBS); sequenced polymers of styrene-ethylene-butadiene (SEBS-SIS); thermoplastic polyurethanes; and mixtures of polypropylene with one of the following elastomers: sequenced polymers of styrene-ethylene-butadiene (SEBS-SIS), terpolymers of ethylene, of propylene and of a diene (EPDM), and sequenced polymers of styrene-butadiene (SBS).

7. A cap according to claim 1, including a gripping zone comprising a layer of an elastomeric material provided on at least one of the body and the lid.

8. A cap according to claim 1, wherein the lid has a stopper which obturates the opening, including an elastomeric material covering interposed between the stopper and the opening to ensure a seal therebetween.

9. A cap according to claim 8, wherein the stopper is filled with the elastomeric material.

10. A cap according to claim 1, wherein the body has an annular gasket of an elastomeric material in leakproof contact with a peripheral edge of the lid when the lid is in a closed position thereof.

11. A unit for dispensing a fluid product, comprising:

a reservoir containing a fluid product;

a dispensing cap comprising a substantially rigid body mountable on a reservoir containing a fluid product, and provided with an opening for dispensing the product; a substantially rigid lid articulated on the body in the vicinity of an articulation axis so as to be capable of selectively passing from an open position to a closed position in which the lid obturates the opening; and an elongatable elastomeric connecting element having one end joined to the lid and another end joined to the body, the one end of the connecting element being disposed on one side of the articulation axis in the open position of the lid and extending to another side of the articulation axis in the closed position of the lid such that said elastomeric connecting element stretches while said lid moves between said open and closed positions.

12. A dispensing cap comprising:

a substantially rigid body mountable on a reservoir containing a fluid product provided with an opening for dispensing the product;

a substantially rigid lid articulated on the body in the vicinity of an articulation axis so as to be capable of selectively passing from an open position to a closed position in which the lid obturates the opening;

an elastomeric connecting element having one end joined to the lid and another end joined to the body, the one end of the connecting element being disposed on one side of the articulation axis in the open position of the lid and extending to another side of the articulation axis in the closed position of the lid; and anchorage means for anchoring and reinforcing the attachment of the connecting element to the body and to the lid such that said elastomeric connecting element stretches while said lid moves between said open and closed positions.

13. A cap according to claim 12, wherein the anchorage means are comprised by bars embedded in the connecting element.

14. A unit for dispensing a fluid product, comprising:

a reservoir containing a fluid product;

a dispensing cap comprising a substantially rigid body mountable on a reservoir containing a fluid product, and provided with an opening for dispensing the product; a substantially rigid lid articulated on the body in the vicinity of an articulation axis so as to be capable of selectively passing from an open position to a closed position in which the lid obturates the opening; and an elastomeric connecting element having one end joined to the lid and another end joined to the body, the one end of the connecting element being disposed on one side of the articulation axis in the open position of the lid and extending to another side of the articulation axis in the closed position of the lid; and anchorage means for anchoring and reinforcing the attachment of the connecting element to the body and to the lid such that said elastomeric connecting element stretches while said lid moves between said open and closed positions.

15. A cap according to claim 1, wherein said elastomeric connecting element is thermofused to both said lid and said body.

16. A cap according to claim 11, wherein said elastomeric connecting element is thermofused to both said lid and said body.

* * * * *